US006079925A

United States Patent [19]

Morgan et al.

[11] Patent Number: 6,079,925

[45] Date of Patent: Jun. 27, 2000

[54] METHOD AND APPARATUS FOR LIFTING OILFIELD GOODS TO A DERRICK FLOOR

[76] Inventors: Carl Morgan, P.O. Box 1122, Artesia, N. Mex. 88211-1122; George L. Scott, III, 100 N. Penn, Roswell, N. Mex. 88201

[21] Appl. No.: 09/100,080

[22] Filed: Jun. 19, 1998

[51] Int. Cl.[7] ..... E21B 19/14

[52] U.S. Cl. ..... 414/22.57; 414/22.58; 414/800

[58] Field of Search ..... 175/52, 85; 414/22.54, 414/22.57, 22.58, 800

[56] References Cited

U.S. PATENT DOCUMENTS

| | | | |
|---|---|---|---|
| 2,535,546 | 12/1950 | Pitts | 414/22.57 |
| 2,643,006 | 6/1953 | King . | |
| 2,656,052 | 10/1953 | Tucker | 414/22.58 |
| 3,053,401 | 9/1962 | Jinkins . | |
| 3,254,776 | 6/1966 | Brown . | |
| 3,315,822 | 4/1967 | Wilson . | |
| 3,559,821 | 2/1971 | James . | |
| 3,706,347 | 12/1972 | Brown . | |
| 3,780,883 | 12/1973 | Brown . | |
| 3,792,783 | 2/1974 | Brown . | |
| 3,916,500 | 11/1975 | Brown . | |
| 4,067,453 | 1/1978 | Moller . | |
| 4,235,566 | 11/1980 | Beeman et al. . | |
| 4,347,028 | 8/1982 | Dugan . | |
| 4,379,676 | 4/1983 | Frias . | |
| 4,380,297 | 4/1983 | Frias . | |
| 4,403,898 | 9/1983 | Thompson . | |
| 4,405,022 | 9/1983 | Will . | |
| 4,439,091 | 3/1984 | Frias . | |
| 4,552,498 | 11/1985 | Dysarz | 414/22.58 |
| 4,684,314 | 8/1987 | Luth . | |
| 5,122,023 | 6/1992 | Mochizuki . | |

FOREIGN PATENT DOCUMENTS

| | | | |
|---|---|---|---|
| 773248 | 10/1980 | U.S.S.R. | 414/22.57 |

*Primary Examiner*—Gregory A. Morse
*Attorney, Agent, or Firm*—Browning Bushman

[57] ABSTRACT

The lifting assembly 10. 110 is provided for lifting oilfield tubular members T onto the floor of a derrick D. The assembly includes a lower base 12 which is positioned at a selected location relative to the derrick, and an upper platform 14 pivotally connected at its rearward end to the base. The upper platform has a substantially planar upper surface with a lateral width sufficient for supporting a plurality of oilfield tubulars T thereon. One or more v-shaped troughs 52, 54 are positioned along the platform each for receiving one of the plurality of oilfield tubular members. A hydraulic ram 16 operates against an inclined slide member 20, 116 for tilting the upper platform 18 relative to the base. A powered ejection unit 34 moves a tubular within the trough with respect to the derrick. A push member 56 substantially encloses the v-shaped trough and pushes the tubular. The method of the invention enhances oilfield operations by reducing delays, and substantially improves worker safety.

37 Claims, 4 Drawing Sheets

METHOD AND APPARATUS FOR LIFTING OILFIELD GOODS TO A DERRICK FLOOR

FIELD OF THE INVENTION

The present invention relates to methods and equipment to lift and position oilfield goods, including casing, drill pipe, tubing, pump rods and other types of downhole oilfield equipment, onto the floor of an oilfield rig, derrick, or completion unit. The invention facilitates the economic recovery of oil and gas reserves by increasing operational efficiencies and significantly reducing accidental injuries to crew members.

BACKGROUND OF THE INVENTION

The petroleum industry uses drilling rigs, derricks, and completion units (hereinafter generally referred to as "derricks") to drill and produce wells. Various types of oilfield tubulars, pump rods and other types of generally cylindrical and elongate equipment are conventionally lifted from a rack or other supporting equipment at or near the ground level to the elevated derrick floor, then are placed in the well for conducting drilling, completion, or stimulation operations. For example, drill pipe is typically added to a well in segmented intervals or joints until the drill pipe string reaches a designated depth in the well, and each pipe joint must be raised from a rack at the ground floor to the elevated derrick floor in order to be grasped by an elevator then run into the well. The oilfield equipment is generally removed from the well at a later date, and is conventionally supported on the rig floor and then lowered back to the rack or other supporting equipment at the ground level. As a further example, production casing is run into the well to a selected depth after a well is drilled. This casing is relatively heavy and cumbersome, and a large number of man hours are expended positioning casing joints onto the derrick floor for a run-in operation. Oilfield tubulars are repeatedly taken out of a hole and placed on a pipe rack, and then tripped back into the hole for conducting petroleum recovery operations.

After production casing is set in a well, various types of generally cylindrical and elongate tools may be run into the wellbore for evaluation purposes, including reservoir testing and cased hole logging tools. In many instances, these test tools are heavy and cumbersome to physically lift and maneuver onto the derrick floor. Crew members commonly experience back injuries while lifting or manipulating this equipment to its desired position on the derrick floor, and expensive oilfield equipment is frequently damaged during this operation. Production rods are also frequently placed within the tubing of a well to facilitate pumping of hydrocarbons from the downhole formation. These production rods are commonly also manually lifted and positioned on the derrick floor for running into and out of the well.

A continuing problem in the well drilling and completion industry is physical injury to oilfield crew members resulting from the manual lifting and positioning of tubulars or other equipment to the desired position on the derrick floor. Some reports indicate that over 40% of injuries to oilfield workers occur as a result of lifting and positioning tubulars and other equipment. Oilfield injuries resulting from these operations decrease the efficiency of the hydrocarbon recovery operations and significantly increase the overall cost of these operations. This pervasive problem is compounded by inadequate levels of experienced oilfield workers in many locations, and results in delayed development of petroleum reserves throughout the world. Serious accidents frequently occur as tubulars and other oilfield equipment are lifted from the ground level position to the derrick floor, and have resulted in severe injury to numerous crew members.

While various systems have been devised for positioning oilfield tubulars, production rods, and other equipment onto the derrick floor, these systems are comparatively slow and thus are not widely used. Lengthy time delays to safely position equipment on the derrick floor are unacceptable to both the well operator and to the crew members. Equipment at a well site may rent for tens of thousands of dollars per day, and any procedure which slows down the run-in or trip-out operation is avoided. Various types of oilfield equipment lifting systems have been devised which utilize a wire rope which extends in a loop from the ground level to the derrick floor and to the top of the derrick, and then back to the ground level. An elongate trough may be secured at each end to the cable and tubulars or other equipment placed in the trough, then the cable pulled along its loop to raise the trough and the equipment to the derrick floor. In addition to being slow and cumbersome, this wire rope equipment typically still requires a great deal of physical effort by multiple crewmen to properly position the oilfield equipment at its desired location on the derrick floor. Also, this wire rope arrangement creates its own safety risks, and is not favored by many oilfield crew members.

U.S. Pat. No. 3,503,401 discloses drill pipe handling equipment which employs a complex arrangement of lifting hydraulic rams to elevate an inclined platform which supports a drill pipe. Once the platform is inclined at its desired level, a hydraulic ejection ram pulls drill pipe onto the derrick floor by lateral movement of a plate relative to the platform. The ejection plate sweeps the entire platform surface when positioning a tubular onto the derrick floor. The ejection ram cylinder is mounted at the forward or elevated end of the platform, and thus the hydraulic lifting rams must be sized for also raising the weight of the ejection ram with the platform to its desired inclination. When initially loading a tubular onto the. horizontal platform, the platform is raised several feet off the ground, and accordingly the drill pipe cannot be easily rolled from a low level pipe rack or other support onto the platform. The equipment as disclosed in the '401 patent is also difficult to assemble and disassemble, and a great deal of time and cost is involved in setting up and taking down the equipment at the well site. The equipment as shown in this patent is thus not in common use for lifting tubulars to a derrick floor.

Equipment which has had some success in placing tubulars onto a derrick floor utilizes a singular tubular-conveying trough which is inclined or positioned from an initial horizontal position at the ground level to an inclined position such that the tubular may be pulled toward the derrick floor. Patents relating to such equipment include U.S. Pat. Nos. 3,559,821, 4,235,566, 4,347,082, 4,371,302, 4,379,676, 4,380,297, 4,382,738, 4,386,883, 4,403,898, 4,426,182, 4,453,872, 4,470,740, 4,474,520, and 4,486,137. The prior art thus discloses a trough for receiving a tubular which may then be inclined or elevated. A push member is commonly moved along the trough by a belt or chain mechanism for the purpose of pulling the tubular onto a derrick floor. The trough must first be inclined to a desired level and then the transport mechanism activated to move the tubular along the trough to the derrick floor. After the tubular is grabbed at the derrick floor, the trough must be lowered back to the ground level, and the process repeated with each tubular joint. These systems are used with some success, but the process is still unfortunately slow and time consuming. As a result, many oilfield workers continue to manually manipulate oilfield tubulars and related downhole equipment to position the equipment at its desired location on the derrick floor.

The disadvantages of the prior art are overcome by the present invention. An improved method and apparatus are hereinafter disclosed for easily and reliably positioning oilfield tubulars and other downhole equipment on the derrick floor. The system of the present invention significantly reduces accidents and injuries to crew members, and does not significantly slow down the run-in or trip-out operations.

SUMMARY OF THE INVENTION

The present invention provides an improved method and apparatus for lifting and properly positioning oilfield goods onto a derrick floor. The apparatus of this invention may be used for positioning tubulars between the ground level and the derrick floor during both a run-in and a trip-out operation. The equipment may also be reliably used to position other types of oilfield equipment onto and off the derrick floor when tripping into or out of a well. Looped cables are not required, and the lifting equipment desirably does not rely on structural support from the derrick.

The lifting equipment includes a generally rectangular upper platform which is attached by a hinge at its rearward end to a slightly larger rectangular lower supporting base. The upper platform is designed for supporting a plurality of tubular joints. The upper platform is selectively inclined by actuation of a horizontally positioned single hydraulic lifting ram which is fixedly attached to the supporting base with the rod end of the lifting ram pushing against the lower end of an inclined slide member. The slide member is pivotally connected to the upper platform, and extension of the lifting ram pushes the rearward end of the slide member vertically closer to its pivot connection on the upper platform, thereby lifting the unhinged or front end of the upper platform. Actuation of the lifting ram thus results in movement of the slide member relative to the supporting base to provide a lever action which lifts the upper platform and each of the plurality of tubular members supported thereon. The lifting ram thus acts indirectly to lift the upper platform, and accordingly a shock load on the elevated upper platform is not transmitted directly to and absorbed by the lifting ram, but rather is largely absorbed by the slide member. A relatively short lifting ram stroke may thus produce the desired inclination of the upper platform. Once the upper platform is tilted to reach a height appropriate to eject a tubular onto the derrick floor, the tubular may be ejected from the upper platform by actuating an ejection ram. Numerous tubular members may be sequentially ejected in this manner, and the upper platform accordingly may be loaded with multiple joints of tubulars, thereby avoiding the need to separately lift each tubular joint to the inclined position.

The injection ram is supported on the upper platform, and is connected to either or both of two v-shaped parallel troughs that longitudinally traverse the length of the upper platform. A sequencing solenoid may be used to selectively release a tubular while supported on the inclined upper platform, so that the next tubular may be rolled into position within the desired v trough. If desired, a ram or other powered unit may be used to roll the next tubular into the v trough. The ejection ram is selectively actuated by the equipment operator to move a tubular along the respective trough and to the derrick floor. Actuation of the ejection ram preferably moves a sleeve along the trough that surrounds the v-shaped trough, thereby substantially enhancing the integrity and reliability of the ejection operation. The sleeve may be configured to move a single tubular member, a bundle of rods, or a specific downhole tool, depending on the configuration of the sleeve. The ejection ram has a cylinder housing positioned adjacent the rearward end of the upper platform, and a pair of elongate rods interconnect the rod end of the ejection ram with the sleeve, so that the sleeve ideally may be positioned adjacent the rearward end of the trough when a tubular or other downhole equipment is positioned within the trough.

The equipment of the present invention is ideally able to elevate multiple tubular joints, and each joint may be successively ejected onto the derrick floor utilizing either of the v troughs. In a preferred method of the invention, one trough may be used for ejecting tubulars onto the derrick floor for tripping into a hole, while the second trough may be used to convey other types of oilfield equipment, including downhole tools, onto the derrick floor. Conversely, when a joint pipe or tubing which is damaged or susceptible is discovered, the second trough may be used to lay down the damaged tubular while the other v trough remains loaded with the next tubular to be run in the hole. The second trough may thus be used for receiving defective tubulars and thus tripping that tubular off the derrick floor while the first trough is used for running tubulars up to the derrick floor.

A significant advantage of the present invention is that a pipe rack may be positioned on either side of the lifting equipment. Prior to the lifting operation, the lifting equipment is raised off the ground level only approximately 12 to 15 inches, and accordingly pipe from even low level racks may be easily rolled onto the upper platform. Once a batch of oilfield tubulars are raised by the platform, the length of each tubular may be easily and quickly determined by a crew member at the derrick floor, thereby enhancing the tally operation. The lifting equipment may be automated so that both the elevation of the platform and the movement of the ejection sleeve along a trough terminate at a preselected position.

It is an object of the present invention to provide an improved technique which minimizes the time required to trip oilfield tubulars and other equipment into and out of a hole by reducing the time necessary to position the tubulars or oilfield equipment on the derrick floor. A related object of the invention is to improve the method for loading and unloading tubulars onto a derrick floor while minimizing undesirable delays.

The primary object of the invention is to provide a system which allows multiple joints of oilfield tubulars to be loaded onto a platform and the platform then raised to elevate each of the tubulars from the horizontal position at a desired inclination with respect to the derrick floor, after which each tubular may be successively ejected from the upper platform to its desired position on the derrick floor. This object of the invention increases the efficiency of oil recovery operations.

Still another object of the invention is to provide an improved technique for loading and unloading oilfield tubulars, pump rods, other oilfield equipment in a manner which significantly reduces the likelihood of injury to oilfield crew members and damage to the oilfield equipment. The present invention is able to significantly reduce those injuries which most commonly occur when oilfield personnel lift equipment or position equipment at the derrick floor. By precisely and safely controlling the movement of tubulars or other equipment, back and other physical injuries to crew members are minimized or avoided.

A significant feature of the invention is that delays associated with lifting and positioning oilfield equipment at the rig floor are minimized. The equipment is relatively simple and is formed from commonly available components, is easy to maintain, and is highly reliable. The lifting equipment is compact and desirably is very low to the ground level prior to raising the platform.

It is a feature of the present invention that the lifting equipment may be easily used to enhance the rate and efficiency of tallying tubular lengths while tripping into and out of the wellbore.

Still another feature of the invention is the improved economics of oil and gas well recovery operations achieved by increasing operational efficiency while avoiding costly downtime due to accidents. By preventing accidents to crew members, the overall expense of hydrocarbon recovery operation may be reduced. Also, the likelihood of damaging oilfield tubulars and other tools is significantly reduced according to the concepts of the present invention.

It is an advantage of the present invention that the lifting equipment may be easily and reliably positioned and placed adjacent a derrick, and may be quickly and inexpensively set up for a run-in or run-out operation.

Still another advantage of the invention is that the equipment is cost effective to manufacture and is highly rugged due to its simplistic design. Hydraulic rams are efficient, simple in application, and highly reliable, thereby minimizing the expense of equipment components.

A further advantage of the invention is that the equipment may be economically manufactured and may be rented or leased at rates which are highly competitive with more complicated or less reliable equipment. The equipment may be automated for minimizing operator action and unnecessary delays.

These and other objects, features and advantages of the present invention will become apparent from the following detailed description, wherein reference is made to the figures in the accompanying drawings.

DETAILED DESCRIPTION OF PREFERRED EMBODIMENTS

Figure 1:
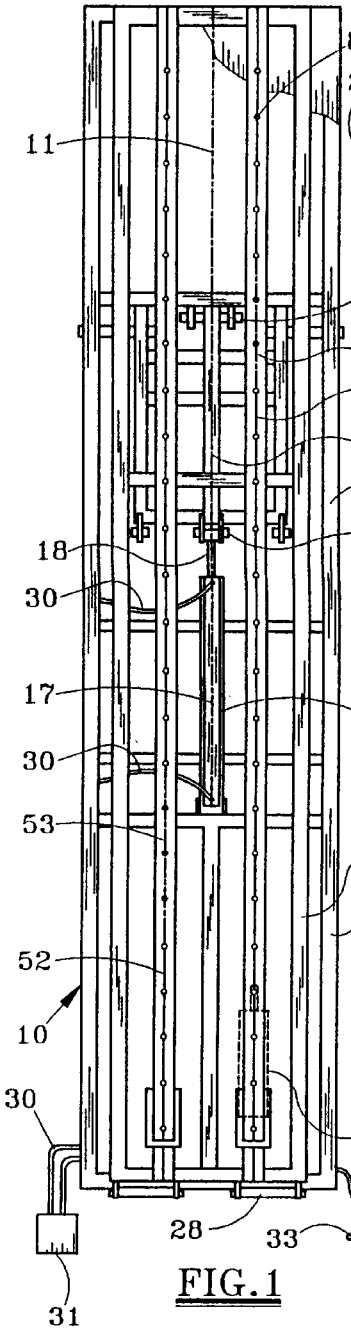
FIG. 1 is the top view of one embodiment of a lifting mechanism assembly in accordance with the present invention.

FIG. 1 depicts a top view of a lifting mechanism assembly for lifting and positioning various oilfield members from a ground level onto a derrick floor. The assembly 10 includes a generally rectangular-shaped base 12 which sits on the ground and is positioned at a selected location from the derrick. An elongate upper platform 14 is positioned above the base 12, and includes a generally planar upper supporting surface 13 thereon (see FIG. 5) for receiving a plurality of oilfield members, such as tubulars T. The base 12 and the upper platform 14 preferably each have a central axis 11 which lies within a common vertical plane. The lateral width of the base 12 is preferably slightly greater than the width of the upper platform 14. Although not shown in FIG. 1, it should be understood that each tubular positioned on the upper platform has a central axis generally parallel with the upper platform axis 11. The length of both the base 12 and the upper platform 14 is typically slightly less than the standard length of 30-foot oilfield tubulars. The width of the upper platform 14 typically may be from four feet to eight feet, depending on the diameter of the tubulars intended to be positioned with the equipment and the number of tubulars to be supported on the upper platform. Both the base and the upper platform are preferably fabricated from structural steel members, such as beams and square tubing, which preferably are welded or bolted together. The assembly 10 may be trailered to a well site and positioned on the ground by forklifts, cranes or other equipment. Alternatively, the assembly 10 may include wheels (not shown) so that the assembly may be towed to a well site and positioned in place with respect to the derrick, and then the wheels either removed or tilted upward relative to the base so that the base rests on the ground.

Figure 3A:
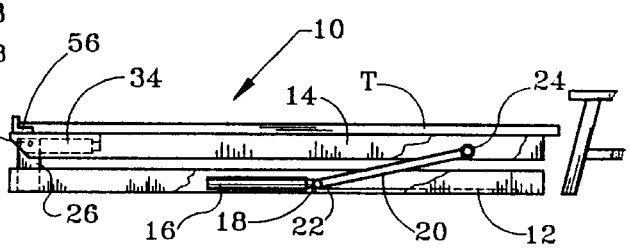
FIGS. 3A, 3B and 3C are simplified side views of the lifting mechanism assembly shown in FIG. 1 in the horizontal, inclined, and inclined and tubular ejected positions, respectively.
Figure 2:
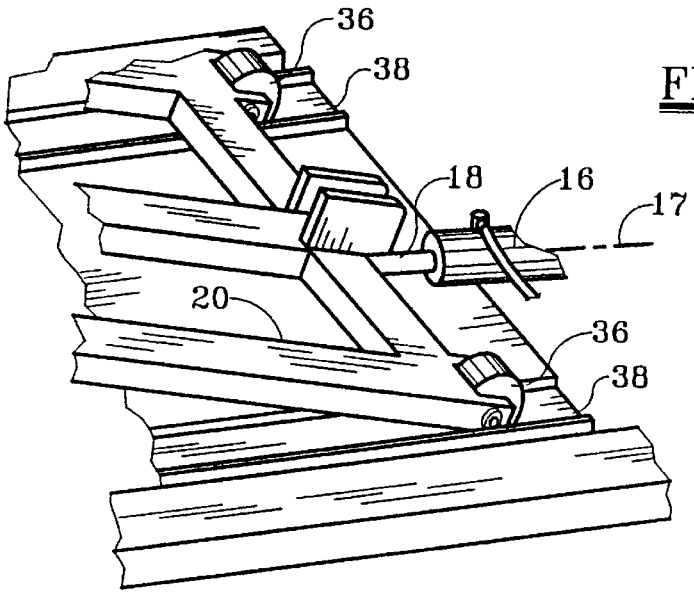
FIG. 2 is a simplified pictorial view of the slide mechanism generally shown in FIG. 1.

The assembly 10 includes a hydraulic ram 16 for tilting the forward end of the upper platform 14 relative to the base 12. The rod 18 of the ram 16 pushes against an inclined slide member 20, which is shown in greater detail in FIG. 2. The lower and rearward end of slide member 20 is pivotally connected at 22 (See FIG. 1) to the rod 18, while the upper and forward end of the slide member is pivotally connected to the upper platform at 24. As shown in FIG. 3A, a pair of spaced supports 26 extend slightly upward from the lower base 12 and are affixed thereto. The rear end of the upper platform is connected to the supports 26 and thus to the base 12 by hinge members 28. Various hydraulic lines 30 connect hydraulic powered equipment on the assembly 10 as discussed subsequently with a conventional hydraulic power source 31. A control station 32, which may be mounted on a portable pedestal, includes a plurality of controls 33 for operator control of flow through the hydraulic lines 30 to power the various components of the equipment, as discussed below.

Referring again to FIG. 2, the slide member 20 may include a rigid generally rectangular-shaped frame which lies within a single inclined plane. Hydraulic ram 16 has its rearward cylinder secured to the base 12 in a conventional manner so that the rod 18 extends in a linear path along the axis 17 of the hydraulic ram, thereby extending the rod 18 when the ram is powered. The lower end of the slide member accordingly is moveable relative to the base 12 along this linear path. The base 10 preferably includes a pair of elongated guide channels 38 secured thereto. A corresponding pair of rollers 36 at the lower end of the slide member 20 each fit within a respective guide channel to guide the lower end of the slide member when the hydraulic ram 16 is activated. The upper end of the slide member is connected to the upper platform by one or more pivot members 24, as shown in FIG. 1. By providing a rectangular shaped slide member, substantial forces required to initiate raising of the upper platform may be reliably transmitted from the hydraulic ram 16 through the slide member and to the upper platform. Most importantly, a shock load transmitted to the upper platform when in a tilted position need not be fully absorbed by the hydraulic ram 16, and instead a substantial portion of any such shock load may be absorbed by the slide member 20. Also, this combination of the hydraulic ram and a slide member allows the assembly 10 to have a low profile when initially loading tubulars onto the assembly, as discussed subsequently, yet allows the upper platform to be tilted to a selected inclination with a relatively short stroke of the hydraulic ram 16.

Referring again to FIG. 1, the upper platform 14 preferably includes first and second v-shaped elongate troughs 52, 54 each for receiving one of the plurality of elongate tubulars T. Each v-shaped trough 52, 54 has a trough axis 53, 55, respectively, which is generally parallel with the central platform axis 11. The troughs 52, 54 and thus the axes 53, 55 are spaced laterally on opposite sides of the central platform axis 11. As shown in FIG. 1, the trough 52 may be considered a left-side trough and the trough 54 a right-side trough. The importance of providing first and second troughs on the upper platform is also discussed further below.

Figure 4:
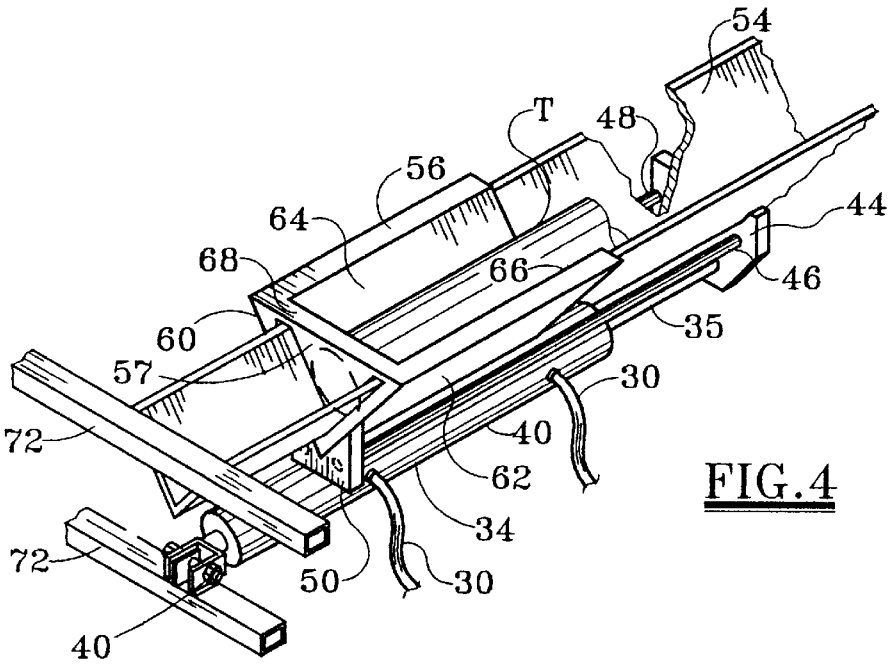
FIG. 4 is a pictorial view of a portion of the apparatus shown in FIGS. 1 and 2, illustrating particularly the lifting cylinder and the v trough sleeve.

Referring now to FIGS. 1 and 4, the assembly 10 includes a powered ejection unit, which preferably comprises a hydraulic ram 34 secured to the upper platform 14 and having a rod 35 extending toward a front-end of the upper platform. A ram 34 may be provided for each of the v-shaped troughs 52, 54, although as shown in FIG. 1 only trough 54 is provided with a powered ram 34. In one embodiment, the ram 34 is secured by removable bolts or pins to the upper platform 14, and thus an operator may easily remove the ram 34 from its position for moving a tubular on the trough 54 and reposition the same ram for moving a tubular along the trough 52.

In FIG. 4, the ram cylinder 40 is shown with hydraulic lines 30 extending therefrom in a conventional manner, so that the rod 42 may be extended or retracted in a conventional manner. The rod 42 is secured to a front plate 44, a clamp (not shown) may removably connect the rod 35 to plate 44. A pair of elongate connecting rods 46 and 48 interconnect to the front plate 44 with the rear plate 50. Preferably the connecting rods 46 and 48 are positioned laterally on opposing sides of the axis of the ram 34. The ram 34 is positioned directly below the v-trough 54, with the top of the ram cylinder 40 spaced only slightly below the v-trough 54 to conserve vertical space. The rods 46 and 48 may thus be positioned on each side of the ram 34, and interconnect the rod 42 of the ram with the rearward plate 50. The plate 50 in turn is connected to a push member 56 which slides along the v-trough 54. The push member 56 preferably includes plates 60 and 62 which are each exterior of the respective sides of the v-trough 54, and interior plates 64 and 66. The lower ends of the plate 60 and 62 are joined together at an apex, and the upper ends of the inner and outer plates of the push member are similarly joined together as shown in FIG. 4, so that the push member 56 substantially encloses the v-trough 54. Within a plane perpendicular to the axis of the tubular T being ejected toward the derrick floor, the push member 52 thus wraps completely around both the outside and the inside of the v-trough 54, thereby substantially enhancing the structural integrity of the tubular ejection unit.

Figure 6:
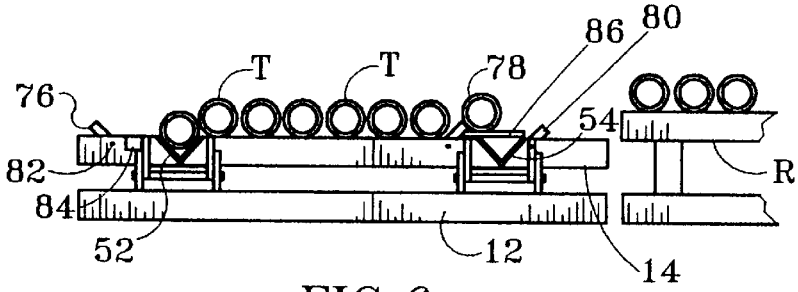
FIG. 6 is a front end view illustrating tubulars rolled from a rack onto the upper surface of a platform.

A significant feature of the invention is that the structural integrity of the assembly, and particularly the components for moving the oilfield tubular or other member onto the derrick floor, which is significantly enhanced by providing a v-trough 52 with sides 52A and 52B as shown in FIG. 6. The sides 52A, 52B are each substantially planar plates which are rigidly joined at apex 52C. The rigid connection of these plates conveniently is provided by stamping or otherwise deforming a unitary plate to form the desired v-shaped configuration. The trough 52 is supported by platform supports at various locations forward and rearward of the travel path of push member 56. As a practical matter, the v-shaped trough should be no higher than the upper surface 13 of the platform 14 so that each tubular may easily roll into the v-shaped trough. The driving force which moves the tubular member along the v-shaped trough and toward the derrick floor practically must be provided below the upper surface 13 of a platform. Prior art equipment has thus generally formed a v-shaped trough with an elongate slit in the area where the apex of the trough otherwise would be, and then provided support for the sides of the v-shaped trough to support the oilfield members as they move along the trough. According to the present invention, however, an elongate slit is not provided in the v-shaped trough, and instead the structural integrity of the trough is enhanced by rigidly joining each of the sides 52A and 52B at the apex 52C along at least substantially the length of the v-shaped trough. Obviously this benefit results in the problem with interconnecting the driving member below the top surface 13 with a push member which sits within the v-shaped trough. As shown in FIG. 4, however, this problem is overcome in a manner which also substantially enhances the integrity of the ejection equipment components by providing the push member 56 which, as noted above, encircles the v-shaped trough. The connection between the driving member and the v-shaped trough may thus be provided with a lower plate 50 as shown in FIG. 4, and by providing a push member which completely encircles the trough, with a portion of the push member 56, including internal plates 64, 66 and rear push plate 57 as shown in FIG. 4. The rear push plate 57 of push member 56 is thus the component that pushes an oilfield member along the v-shaped trough 54. As shown in FIG. 1, each of the troughs 52 and 54 may be provided with a plurality of space drain holes 88 at selected lengths along each trough to ensure that water does not collect in the bottom of the trough. These drain holes do not adversely affect the desired structural integrity of the v-shaped trough, as noted above.

Figure 5:
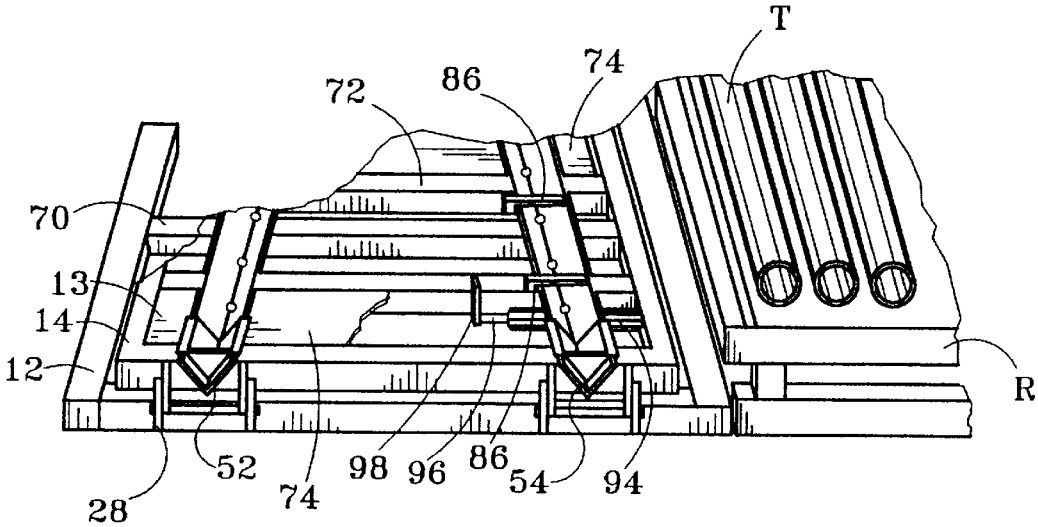
FIG. 5 is a simplified pictorial view illustrating tubulars on a rack before being rolled onto the lifting mechanism assembly prior to the assembly being inclined.

As shown in FIG. 5, the lifting equipment is very low to the ground before the upper platform is tilted. This is a further significant feature of the invention, since this feature allows oilfield tubulars positioned on a relatively low rack R as shown in FIG. 5 to be easily rolled onto the upper surface 13 of the platform without raising each tubular up to that surface. According to the present invention, the upper surface 13 of a platform is no more than 18 inches above the lower ground engaging surface of the base before the upper platform is tilted, and preferably is less than 15 inches above the ground. A plurality of tubulars may thus be rolled from the rack R onto the upper surface of the base. A plurality of fingers 86 may be pivotally connected to the upper platform so that tubulars will roll across a selected one of the troughs and will not drop into that trough while the tubulars are loaded onto the platform. These fingers 86 may subsequently be turned to an inactive position, so that a tubular may then drop into that trough.

The upper platform may be provided with stop fingers 76 and 80 on opposing sides of the upper platform 14, as shown in FIG. 6, for ensuring that tubulars do not unintentionally roll off the upper platform 14. Each stop finger may be rotated about a respective pivot 82. A plurality of catch and release fingers 78 may be provided on the upper surface for stopping a tubular T from rolling into one of the troughs. The stop and release finger 78 as shown in FIG. 6 may subsequently be rotated to an inactive position, so that a single tubular passes by the finger 78, allowing a tubular to roll into trough 54. The finger 78 as shown in FIG. 6 then automatically returns to the active position to stop the next tubular from unintentionally rolling into the v-shaped trough 54. Each of the fingers 78, 80, 82 and 86 if desired may be automatically controlled by an electric solenoid 84, or by another suitable powered member, such as a simple pneumatic cylinder. If desired, each finger may be spring biased into the active position, so that the solenoid is activated to force the finger to an inactive position. The spring or other biasing member then automatically returns the finger to the active position when power to a solenoid is interrupted.

FIG. 5 also depicts that both the base 12 and the upper platform 14 are provided with suitable bracing and other cross members. The base 12 is shown with a plurality of frame crossbars 70 which extend laterally across the elongate sides of the frame. Similar frame crossbars 72 are provided for structurally interconnecting the elongate sides of the upper platform 14. Both the front portion and a rear portion of the upper platform may be provided with a planar plate or mesh-like material 74 which serves several purposes. First, an operator can thus easily walk along portions of the upper platform to operate the various fingers discussed above. Also, a very short tubular member, such as a downhole tool, can be reliably rolled from a rack or a forklift truck onto the rear portion of the upper platform, with the tool rolling along the plate 74 and into the trough without the risk of the tool dropping between the cross bases of the upper platform. Similarly, if a tubular is run out of the well or is otherwise removed from the derrick platform onto the tilted upper platform, the upper portion of the plate 74 may engage the lower end of the tubular as it is lowered, so that an operator may then easily slide the lower end of the tubular along the plate 74 and into the desired v-shaped trough.

Referring now to FIG. 3, the method of utilizing the equipment may be more fully understood. In the FIG. 3A position, assembly 10 has the upper platform in its horizontal position so that a plurality of oilfield tubulars may be easily rolled onto the upper platform, as discussed above. The ram 16 is fixed to the lower base 12 as previously noted, with the inclined slide member 20 interconnecting the rod 18 with the upper platform. The ejection ram 34 as more fully shown in FIG. 4 is structurally secured to the upper platform, and is subsequently actuated to move the push member 56 as shown on FIG. 4 and thus the tubular T along the v-shaped trough.

Figure 3B:
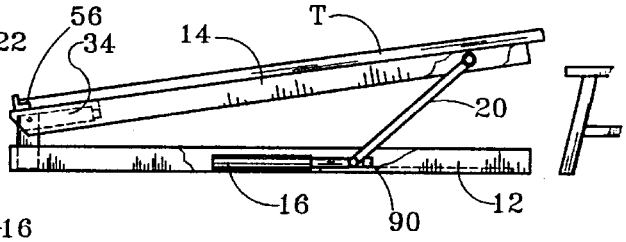

Once a plurality of tubulars have been rolled onto the upper platform, the ram 16 is actuated to extend the rod 18, as shown in FIG. 3B, thereby pushing the lower most end of the slide member 20 toward the front end of the base 12 and tilting the platform 14 upward. All the tubulars supported on the upper platform are simultaneously tilted upward with the upper platform. The desired inclination of the upper platform 14 will depend upon the height of the derrick floor and the lateral spacing between the lifting equipment and the derrick floor. In most cases, however, the upper platform will be at its desired inclination when the upper platform is angled less than 30 degrees with respect to the base 12. Once the desired inclination of the upper platform is achieved, the operator may secure the position of a switch 90, as shown in FIG. 3B, to the base 10. The switch 90 may be connected to the control panel 32 which regulates power to the ram 16. Each time the ram 16 is extended to a position which will result in the desired tilting of the upper platform 14, the switch 90 will be automatically activated and the control panel 32 may then automatically terminate power to the ram 16. In this manner, the operator may selectively actuate the ram 16 but need not carefully control the tilting operation since the power to the ram will automatically terminate when the platform reaches its desired inclination. Another safety switch (not shown) may be provided to ensure that the power of the ram 16 will automatically terminate if for some reason the switch 90 is not properly set, thereby ensuring that the upper platform can only be tilted to a maximum position before power to the ram 16 is interrupted. Also, those skilled in the art should appreciate that the switch 90 may be provided at different locations than that shown in FIG. 3B which nevertheless will be responsive to the extension of the ram 16 and thus the inclination of the upper platform.

Figure 3C:
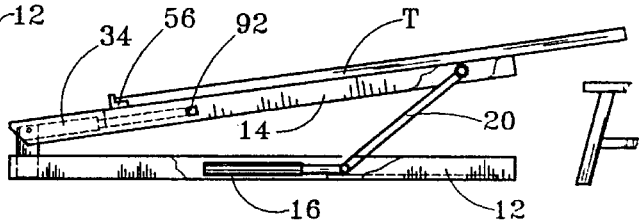

Once the upper platform and all the tubulars T supported thereon are at a desired inclination, one of the tubulars T may be rolled into the selected v-shaped trough, and the ram 34 then activated to slide the push member 56 toward a front end of the upper platform, thereby pushing at least the front end of the tubular T to a desired position with respect to the derrick floor. After the tubular T has been grasped by the elevator or otherwise removed from the trough, the ram 34 may be deactivated to return a push member 56 to the rearward end of the upper platform 14, and the next tubular then rolled in the trough. This process may be repeated until each of the tubulars supported on the upper platform is sequentially pushed into position with respect to the derrick floor. As shown in FIG. 3C, another limit switch 92 may be provided for automatically terminating power to the ram 34 when the push member 56 is at a selected position along the length of the trough. The operator may thus position the limit switch 92 so that the ram 34 stops when a sufficient length of the tubular has been safely positioned onto the derrick floor. Since the length of the oilfield members may change, an override switch may be provided on the control panel 32 so that the operator can continue power to the ram 34 even if the switch 92 were activated. A short tubular or other downhole tool may then be pushed along the trough to a sufficient extent to reach the derrick floor by overriding the response from switch 92. Also, those skilled in the art will appreciate that various length "blanks" may be positioned in the v-shaped trough between the push member 56 and a tool. Each of these blanks thus serves as a extension of the push member 56, so that even relatively short downhole tools may be rolled onto the forward end of a v-shaped trough, then the ram 34 activated to safely position that short downhole tool onto the derrick floor. It may be appreciated that a plurality of tubulars may thus be sequentially positioned onto the derrick floor without the process involving the raising and lowering of the upper platform. Once all the tubulars are positioned onto the derrick floor and the upper platform is emptied, the ram 16 may be deactivated to return the upper platform to the horizontal position as shown in FIG. 3A, and the process then again repeated.

It is a feature of the present invention that the upper platform 14 is elevated by a hydraulic ram with its cylinder affixed to the base 12 adjacent the rearward end of the base, and with the rod then extending toward the front of the base when the ram is actuated. Preferably the inclined slide member is provided with its lower end positioned more rearward, i.e., opposite a forward end of the base with respect to the rod end of the inclined slide member, so that the rod 18 of the ram 16 is extended to tilt the elongate upper platform, as shown in FIG. 3B. It is thus preferable that the ram 16 be extended to raise the upper platform, rather than being retracted to perform this operation. The stroke length of the ram could be shortened somewhat if the inclined slide member were positioned so that both its lower end and its upper end were positioned nearer the rear end of the base. This undesirably would either require that the ram 16 have a higher output since more force would be required to push the slide member, or would require that the rod end of ram 16 extend toward the rear of the base, or would require that the slide member 20 be tilted from the position shown and that the upper platform be raised by retracting rather than extending the rod 18 of the ram 16.

It is also a feature of the present invention that the powered ejection unit is a hydraulic ram, and that this ram similarly has its cylinder 40 as shown in FIG. 4 positioned adjacent the rear end of the upper platform, with the rod 35 extending therefrom and toward a front end of the upper platform. By providing the hydraulic ejection ram, the reliability of the ejection operation is substantially enhanced compared to equipment which utilizes a continuous belt or chain drive mechanism. Again, one might consider it initially advantageous to provide the ejection ram with its cylinder end toward the front end of the elongate base, so that the rod extended toward a rear end of the base, and the rod then be retracted within the cylinder to pull the push member and thus the tubular along the trough and upward to the derrick floor. In accord with the present invention, however, it is preferred to utilize the pushing pressure of the ejection ram rather than pulling pressure to move the push member toward the derrick floor. This creates the problem, however, since the rod 35 inherently is spaced nearer to the front end of the upper platform then the desired position for the push member 56, which preferably is very close to the rear end of the upper platform. As noted earlier, this difficulty is overcome by providing the connection members, which preferably consist of the spaced apart connection rods 46 and 48 which structurally interconnect the rod 35 of the ejection ram 34 with the push member 52, so that the push member is moved along the elongate trough by a pushing action of the ejection ram. Also, this feature ensures that most of the weight of the ejection ram, which is inherently in the cylinder portion of the ram, is spaced closely adjacent the rear end of the upper platform, and accordingly the lifting cylinder 16 need not be sized to raise the full weight of the ejection ram, which would be required if the ejection ram were positioned at the front end of the upper platform.

In most cases, it is envisioned that a crew member positioned on the derrick floor or a crew member positioned on the ground will easily roll a tubular onto the desired v-trough, then the cylinder 34 activated to position that tubular onto the derrick floor, then the cylinder 34 deactivated to return the push member 56 to the rearward end of the upper platform, and the process repeated. In certain instances, and particularly when handling very heavy tubular goods, it may be desirable to provide a powered loading unit for automatically moving an oilfield member which is on the upper platform into the v-shaped trough. The force required for this operation should be relatively small, since the oilfield member need only be rolled onto the v-shaped trough. Assuming the fingers 86 covered the v-shaped trough 54 as shown in FIG. 5 to temporarily render that trough inactive, a suitable powered loading unit may be a hydraulic ram 94 as shown in FIG. 5 which has its rod 96 normally retracted to position a moveable stop 98 against the last of the oilfield members. Power to the ram 94 may be used to extend the rod 96, and thus push the plate 98 toward the v-trough 56, thereby rolling each of the oilfield members toward the v-shaped trough 52. Power to the cylinder 94 may be interrupted when one of the oilfield members falls within the v-trough 52, and the ram 94 again only activated after that tubular has been moved onto the derrick floor and the push member 56 returned to its rearward position along the v-trough 54. Those skilled in the art will recognize that other forms of powered loading units may be provided for moving an oilfield member which is on the upper platform into the desired v-shaped trough. If desired, a lateral slot with a short axial length could be provided in the trough 52 so that the loading unit could act on a tubular on the opposite side of trough 54. Also, the loading ram could be operated by a pulling force rather than a pushing force, since as noted earlier this loading force to roll an oilfield member to a trough is a relatively small force.

The method of lifting oilfield members onto a derrick floor with the equipment 10 as discussed above will now be further described. Once the base 10 has been positioned at a selected location on the ground relative to the derrick floor, a plurality of oilfield members will be rolled onto the upper platform 14 from an adjacent rack, which may be positioned on either side of the assembly 10. The various finger mechanisms 76, 78, 80 and 86 may be manually positioned during this loading operation, or as previously described small hydraulic cylinders or solenoids may be activated from the control panel 32 to desirably position these fingers. Each of the oilfield members, such as tubulars T, will thus be supported on the upper platform with each member having a tubular axis generally parallel to the central platform axis 11.

The operator at control panel 32 may then activate cylinder 16 to tilt the upper platform with the plurality of oilfield members thereon at a selected angle relative to the base. During this lifting operation, one of a plurality of oilfield members may be positioned within a selected one of the one or more v-shaped troughs while the upper platform is tilted, or alternatively the first oilfield member may be positioned within the trough after the lifting operation. In either event, the tilting operation may automatically terminate when the switch 90 as shown in FIG. 3B is activated. The oilfield member within the trough may then be positioned on the derrick floor by operating the ram 34, thereby moving the push member 56 along the v-shaped trough and pushing the oilfield member to a desired position on the derrick floor. Again, this pushing operation may automatically terminate when the switch 92 as shown in FIG. 3C is activated. After the first oilfield member is pulled out of a v-shaped trough, the operator on the derrick floor and/or an operator on the ground may roll the next tubular into the v-shaped trough, until the process is repeated until all of the oilfield members supported on the platform are raised to the derrick floor. Alternatively, the cylinder 94 as shown in FIG. 1 may be activated to provide a powered source for rolling each successive oilfield member into the v-shaped trough.

A particular feature of the present invention is to provide first and second v-shaped troughs as shown in FIG. 1, with the troughs being positioned on opposite sides of the center line 11 of the upper platform. By providing two v-shaped troughs, the first trough may be used for pushing each oilfield member successively onto the derrick floor. If a problem occurs during the makeup of the threads or if a crew member realizes that one of the oilfield members is otherwise defective, that defective oilfield member may be taken off the derrick floor by positioning its lower end within the second v-shaped trough, and the remaining tubulars ejected onto the derrick floor utilizing the first v-shaped trough. Once the other tubular members on the platform have been loaded onto the derrick floor and the platform is returned to its horizontal position, the defective tubular may be removed from the platform and another batch of oilfield members loaded onto the platform. Alternatively, crew members may find it beneficial to utilize the first trough to successively push a plurality of oilfield tubular members onto the platform as discussed above, while another type of oilfield member, such as a downhole tool, is positioned within the second trough. When the downhole tool is then desired to be positioned on the platform, the sequence of loading tubulars from the first trough may be interrupted and the ram activated to push the downhole tool onto the derrick floor. As previously noted, various sized blanks may be positioned between the push member and the downhole tool to accomplish this purpose. After the downhole tool is loaded onto the derrick floor, the remainder of the oilfield members may be raised to the derrick floor utilizing the first trough.

As previously noted, hydraulic ram 34 is preferably pinned or otherwise removably positioned between the upper platform support and the rods 46, 48, so that an operator can easily move that ram from the first trough and the second trough. Alternatively, a hydraulic ram 34 may be provided for each of the first and second troughs, particularly under circumstances where it is likely that both push members for the first and second troughs will be repeatedly used. In another embodiment, only a single v-shaped trough will be provided on the upper platform. If this single trough is laterally centered on the upper platform, finger members as discussed above may be used so that oilfield tubular members can be loaded on each side of the single trough. In another embodiment, a single trough may be laterally spaced to one side of the upper platform, in which case oilfield members may be loaded onto the upper platform with one member positioned in the trough, and the remaining oilfield members positioned only on one side of the single v-shaped trough.

Figure 7:
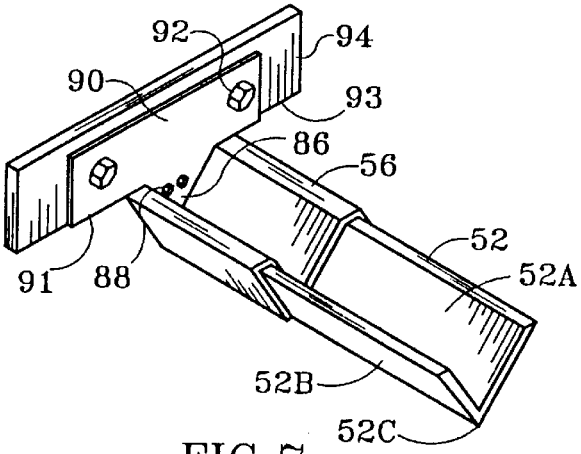
FIG. 7 is a pictorial view of a modification to the v trough sleeve.

FIG. 7 discloses a modification to the push member 56. The rear plate 57 of the push member 56 as shown in FIG. 4, which is the plate that normally engages the lowermost end of a oilfield tubular member, may include a plurality of holes therein. A bracket 90 as shown in FIG. 6 may be secured by bolts 88 to this end plate 57, with the lower plate surfaces 91 then sliding along the upper surface 13 of the platform. The lower v-shaped end 86 of plate 90 then fits within the trough 52. If desired, a much larger plate 94 may be bolted or otherwise secured by member 92 to the plate 90, with its surface 93 again sliding along the upper platform. With the modifications to the push plate as shown in FIG. 6, a bundle of sucker rods or other elongate members which do not have a large diameter may be pushed as a group onto the upper surface of the derrick floor.

Figure 8:
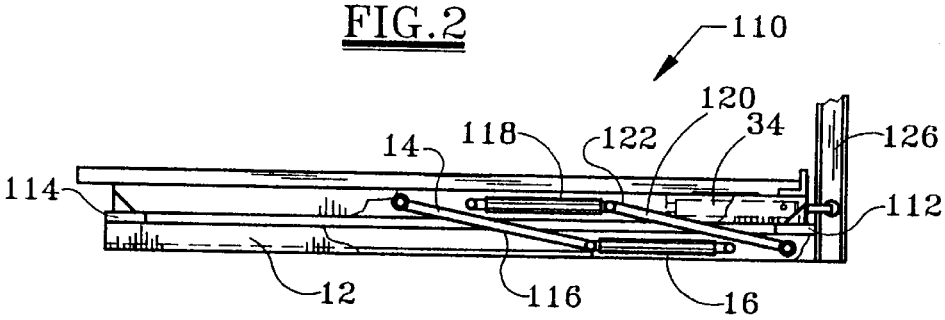
FIG. 8 is a side view of an alternate embodiment of a lifting mechanism assembly in accordance with the present invention.
Figure 9:
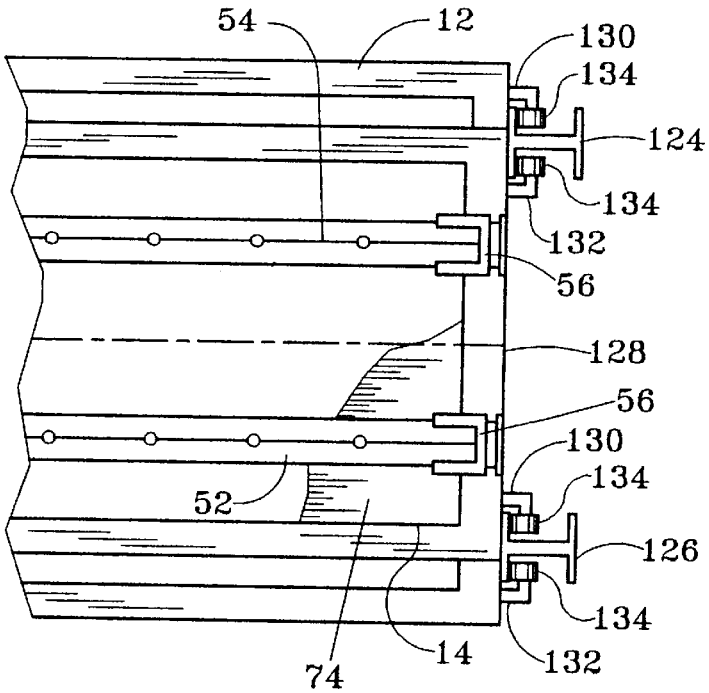
FIG. 9 is a top view of a portion of the lifting mechanism assembly shown in FIG. 8.
Figure 10A:
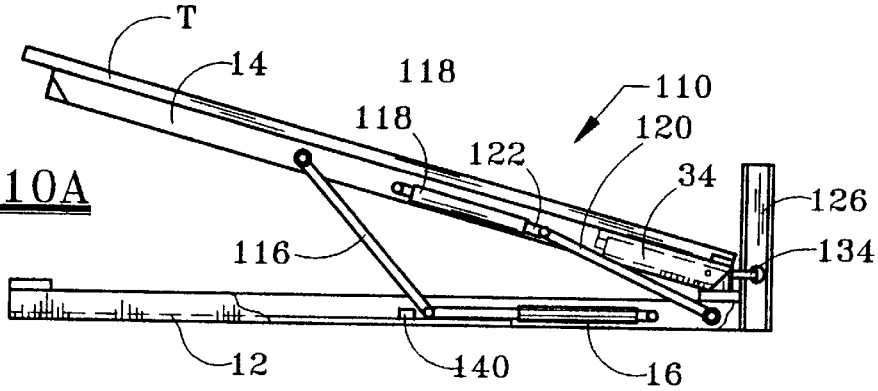
FIGS. 10A and 10B are simplified side views of the lifting mechanism assembly shown in FIG. 7 in the inclined and inclined/platform rear raised positions, respectively.
Figure 10B:
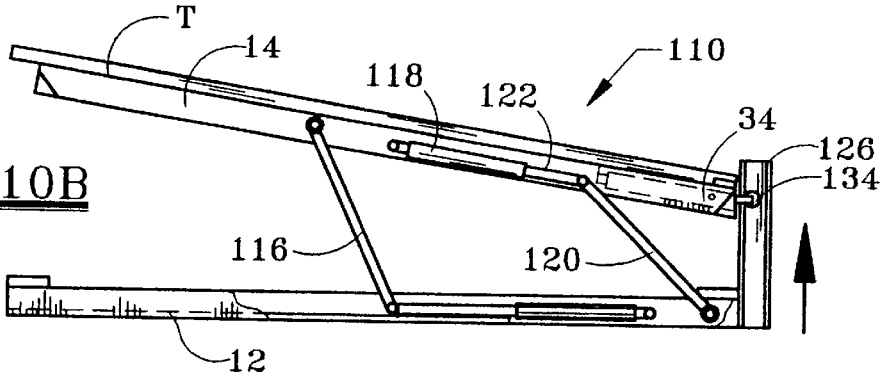

FIGS. 8, 9 and 10 depict another embodiment of equipment 110 for lifting oilfield members onto a derrick floor. Equipment 110 may include the various options and features discussed above. Rear and front pads or spacers 112 and 114 are provided for maintaining a slight spacing between the top surface of the base and the lower surface of the upper platform, since as discussed subsequently the supports 26 and hinge as previously discussed are not used for this embodiment. A first hydraulic ram 16 is provided for tilting the upper platform relative to the lower base at a selected angle, and a first inclined slide member 116 interconnects the rod end of the ram 16 with the upper platform. The cylinder 16 may have a longer stroke than the cylinder previously discussed, and the first slide member 116 has a length between its ends which is longer than the slide member previously discussed, since the embodiment 110 is able to raise the top of the upper platform 14 higher than the previously described embodiment. The ejection ram 34 for operating the push member 56 is generally shown, and functions in the same manner as previously discussed. As shown in FIG. 10B, a second hydraulic ram 118 is provided for raising a rear end of the upper platform 14 relative to the base. In a preferred embodiment, a second slide member 120 is pivotally connected at its upper and forward end to the rod 122 of the second ram 118, and is pivotally connected at its lower and rearward end to the base 12.

As shown in FIGS. 8 and 9, assembly 110 includes vertical guide members 124 and 126, which in one embodiment may comprise H beams spaced on opposing sides of the centerline of the central platform axis, with the lower end of each H beam being affixed to the base 12. As shown in FIG. 9, brackets 130 and 132 may be secured to the rearward end of the upper platform 14, with these brackets fitting within the spaced plates provided by the vertical H beams. The brackets thus ensure that the upper platform cannot move laterally or along the axis of the upper platform any significant distance relative to the base. In a preferred embodiment, a roller 134 is provided at the end of each bracket by reducing the force necessary to raise the lower end of the upper platform when sliding along the vertical guide members. In one embodiment, upper and lower vertically spaced plates (not shown) may each be secured to the base 12, with each plate having a pocket therein for slidably receiving one of the respective H beam 124, 126. When the equipment 110 is positioned at the well site relative to the upper platform, the H beams may be lowered into the respective pockets so that they effectively become rigid with respect to the base. When lowering an H beam into the pockets in the plates, the upper platform and the brackets 130 and 132 secured thereto may be positioned so that the end of the H beam slides between the brackets and the rollers 134 as the beam is lowered in place.

The method of operating the equipment 110 as shown in FIGS. 8 and 9 may be more readily understood by reference to 10A and 10B. Once the plurality of oilfield members are loaded onto the upper surface of the platform as previously discussed, the ram 16 may be operated to extend the rod and push the lower end of the slide member 116 forward relative to the upper end of a slide member 116, thereby raising the upper platform 14 into the position as shown on FIG. 10A During this tilting operation, the lower end of the slide 120 remaining pivotally secured to the base 10, and the rod 122 of ram 118 extends slightly, but the ram 118 is not powered. Assuming that the crew members wish to raise the upper platform to a higher level, which typically would be desired if the platform were adapted for top drive applications, the operator at the control panel may then activate the cylinder 118, which will cause extension of rod 122. The upper end of the second slide member 120 will then be further pushed rearward to the position as shown in FIG. 10B, thereby raising the rear end of the upper platform. During this raising operation, the rear end of the upper platform is guided by the beams and brackets as shown in FIG. 9.

A limit switch may be used as previously discussed to initially terminate power to the cylinder 16 when the upper platform reaches an inclination as shown in FIG. 10A. If further raising of the upper platform is desired, the second ram cylinder 118 may be operated. The signal from the switch 140 as shown in FIG. 10A may then cause the simultaneous activation of the cylinders 16 and 118, so that both the forward and rearward ends of the upper platform 14 are simultaneously raised. Additional limit switches (not shown) may be used for automatically terminating power to the cylinders 16, 118 when the respective front end or the rear end of the upper platform 14 reach its desired position.

Various alternative embodiments of a lifting apparatus and of a method of raising oilfield members to a derrick floor will be suggested from the foregoing description. For example, various powered lifting mechanisms may be used for raising the upper platform, although one or more hydraulic rams are a preferred embodiment. If a rear platform raising ram is utilized, it preferably is secured to the upper platform, although less desirably it could be secured to the lower platform, particularly if its axis were offset laterally from the axis of ram 16. Various types of guide members may be utilized for allowing the rear end to be raised upward while ensuring that the upper platform rear end does not move laterally or axially with respect to the base, and only one embodiment of such a guide mechanism is disclosed herein. It is preferred that the lifting mechanisms not employ hydraulic cylinders which simply lift the platform vertically, since for those embodiments the hydraulic cylinders either become very expensive and/or the upper surface of the platform inherently is raised substantially off the ground level, which is undesirable. Thus a preferred embodiment of the invention utilizes a slide member as disclosed herein for cooperation with hydraulic rams to achieve this lifting purpose. Depending on the size of the equipment, pneumatic ram assemblies could be used in some applications.

Various other modifications and variations of the equipment and the methods may be made without departing from the spirit of the invention. It should thus be understood that such alternative forms and embodiments may be made without departing from the scope of the invention, which is set forth in the following claims.

What is claimed is:

1. Apparatus for lifting oilfield members onto a derrick floor, comprising:

a lower base for positioning at a selected location relative to the derrick floor;

an elongate upper platform connected at its rearward end to the lower base, the upper platform having a substantially planar supporting surface, a central platform axis and a lateral width for supporting a plurality of oilfield members thereon each having a tubular axis generally parallel with a plane including the substantially planar supporting surface;

one or more v-shaped troughs positioned along and secured to the elongate platform each for receiving one of the plurality of oilfield members, each v-shaped trough having a trough axis generally parallel with the central platform axis;

a hydraulic ram for tilting the upper platform relative to the lower base at a selected angle; and a powered ejection unit for moving an oilfield member received within a selected one of the one or more v-shaped troughs while the upper platform is tilted at its selected angle, thereby positioning at least an upper end of the oilfield member at a desired position relative to the derrick floor.

2. The apparatus as defined in claim 1, wherein the upper platform has a generally rectangular configuration, and wherein the base has a rectangular configuration with a lateral width at least as wide as the lateral width of the upper platform.

3. The apparatus as defined in claim 1, wherein the one or more v-shaped troughs include first and second troughs, the first trough axis being spaced laterally opposite the central platform axis with respect to the second trough axis.

4. The apparatus as defined in claim 1, wherein the planar supporting surface of the elongate upper platform is positioned no more than 18 inches above a lower ground engaging surface of the lower base when the elongate upper platform is not tilted relative to the lower base.

5. The apparatus as defined in claim 1, further comprising:

an inclined slide member pivotally connected to the upper platform at its upper end and slidably moveable relative to the lower base at its lower end; and the lower end of the inclined slide member being moveable relative to the lower base by the hydraulic ram along a linear path parallel to an axis of the hydraulic ram.

6. The apparatus as defined in claim 5, further comprising:

the base including an elongate guide channel; and a roller at the lower end of the inclined slide member for fitting within the elongate guide channel to guide the lower end of the inclined slide member along the linear path.

7. The apparatus as defined in claim 1, wherein a left side of each of the one or more v-shaped troughs and a right side of the same trough are fixedly secured together at an apex of the v-shaped trough.

8. The apparatus as defined in claim 1, further comprising:

the powered ejection unit is a hydraulic ejection ram fixed to a rearward end of the upper platform for extending a rod toward a forward end of the upper platform to move the oilfield member along the selected use of the one or more v-shaped troughs.

9. The apparatus as defined in claim 8, further comprising:

an elongate connection member structurally interconnecting the rod of the hydraulic ejection ram with a push member for engaging the oilfield member while the push member is moved along the selected one of the one or more v-shaped troughs by the hydraulic ejection ram.

10. Apparatus for lifting oilfield members onto a derrick floor, comprising:

a lower base for positioning at a selected location relative to the derrick floor;

an upper elongate platform connected at its rearward end to the lower base, the upper platform having a central platform axis and a lateral width for supporting a plurality of elongate oilfleld members therein each having a tubular axis generally parallel with the central platform axis;

a v-shaped trough along the elongate platform for receiving one of the plurality of oilfield members, the v-shaped trough having a trough axis generally parallel with the central platform axis;

an inclined slide member pivotally connected to the upper platform at its upper end and slidably moveable relative to the lower base at its lower end;

a hydraulic ram for moving the lower end of the inclined slide member along a linear path relative to the base to tilt the upper platform at a selected angle; and a powered ejection unit for moving an oilfield member received within the v-shaped trough while the upper platform is tilted at its selected angle, thereby positioning at least an upper end of the oilfield member at a desired position relative to the derrick floor.

11. The apparatus as defined in claim 10, wherein the elongate platform has a generally rectangular configuration, and wherein the base has a rectangular configuration with a lateral width at least as wide as the lateral width of the upper platform.

12. The apparatus as defined in claim 10, further comprising:

the lower end of the inclined slide member being positioned opposite a forward end of the lower base with respect to the upper end of the inclined slide member, such that the rod end of the hydraulic ram is extended to tilt the elongate upper platform.

13. The apparatus as defined in claim 5, further comprising:

the base including an elongate guide channel secured to the base; and a roller at the lower end of the inclined slide member for fitting within the elongate guide channel to guide the lower end of the inclined slide member along the linear path.

14. The apparatus as defined in claim 10, further comprising:

a tilt position switch for sensing the position of the hydraulic ram and for terminating power to the hydraulic ram when the elongate upper platform reaches a selected inclination with respect to the lower base.

15. The apparatus as defined in claim 1, further comprising:

a powered loading unit for moving an oilfield member supported on the upper platform into the v-shaped trough.

16. Apparatus for lifting oilfield members onto a derrick floor, comprising:

a lower base for positioning at a selected location relative to the derrick floor;

an elongate upper platform connected at its rearward end to the lower base, the upper platform having a central platform axis and a lateral width for supporting a plurality of elongate oilfield members thereon each having a tubular axis generally parallel with a plane including the substantially planar supporting surface;

a v-shaped trough along the elongate platform for receiving one of the plurality of oilfield members, the v-shaped trough moveable with the elongate upper platform having a trough axis generally parallel with the central platform axis;

a first hydraulic ram for tilting the upper platform relative to the lower base at a selected angle;

a second hydraulic ram for moving an elongate oilfield member within the trough while the platform is lifted at the selected angle, the second hydraulic ram having a cylinder mounted to a rearward end of the upper platform and a rod extending from the cylinder toward a forward end of the upper platform; and a push member for engaging the oilfield member while moving along the v-shaped trough in response to the second hydraulic ram to push the oilfield member toward the derrick floor, the push member at least substantially enclosing the v-shaped trough.

17. The apparatus as defined in claim 16, further comprising:

an ejection position switch for sensing the position of the push member relative to the v-shaped trough and for terminating power to the second hydraulic ram when the push member reaches a selected position.

18. The apparatus as defined in claim 16, further comprising:

an elongate connection member structurally interconnecting the rod of the second ram and the push member, the second ram having a second ram axis generally parallel with the central platform axis.

19. The apparatus as defined in claim 18, wherein the elongate connection member comprising first and second laterally spaced rods each extending from the rod of the second hydraulic ram to the push member, the first of the elongate rods being positioned laterally opposite the second ram axis with respect to the second of the elongate rods.

20. The apparatus as defined in claim 16, further comprising:

a plate member moveably secured to the push member for sliding engagement with at least a portion of an upper planar surface of the elongate upper platform.

21. Apparatus for lifting oilfield members onto a derrick floor, comprising:

a lower base for positioning at a selected location relative to the derrick floor;

an elongate upper platform connected at its rearward end to the lower base, the upper platform having a substantially planar supporting surface, a central platform axis and a lateral width for supporting a plurality of oilfield members thereon each having a tubular axis generally parallel with the central platform axis;

a v-shaped trough positioned along the elongate platform for receiving one of the plurality of oilfield members, the v-shaped trough having a trough axis generally parallel with the central platform axis;

a first hydraulic ram for tilting a front end of the upper platform relative to the lower base;

a second hydraulic ram for raising a rear end of the upper platform relative to the lower base; and a vertical guide member secured to the base for guiding the rear end of the upper platform when raised by the second hydraulic ram, the rear end of the upper platform being slidable along the vertical guide when raised by the second hydraulic ram.

22. The apparatus as defined in claim 21, wherein the vertical guide member comprises first and second vertical guide members spaced on opposing sides of the central platform axis.

23. The apparatus as defined in claim 21, further comprising:

one or more rollers each at a rearward end of the upper platform for reducing the force necessary to raise the lower end of the upper platform when sliding along the vertical guide member.

24. The apparatus as defined in claim 21, further comprising:

a first inclined slide member pivotally connected to the upper platform at its upper end and slidably movable relative to the lower base at its lower end;

the lower end of the first inclined slide member being moveable relative to lower base by the first hydraulic ram along a linear path parallel to an axis of the first hydraulic ram;

a second inclined slide member pivotally connected at one end to one of the lower base and the upper platform; and an opposing end of the second inclined slide member being moveable by the second hydraulic ram along a linear path parallel to an axis of the second hydraulic ram.

25. The apparatus as defined in claim 24, further comprising:

a powered ejection unit for moving an oilfield member received the v-shaped trough toward the derrick floor while the upper platform is tilted at its selected angle, thereby positioning at least an upper end of the oilfield member at a desired position relative to the derrick floor.

26. The apparatus as defined in claim 25, further comprising:

a push member for engaging the oilfield member while moving along the v-shaped trough in response to the powered ejection unit to push the oilfield member toward the derrick floor, the push member at least substantially enclosing the v-shaped trough.

27. The apparatus as defined in claim 26, further comprising:

an ejection position switch for sensing the position of the push member relative to the v-shaped trough and for terminating power to the second hydraulic ram when the push member reaches a selected position.

28. A method of lifting oilfield members onto a derrick floor, comprising:

positioning a lower base at a selected location relative to the derrick floor;

positioning an upper platform above the lower base;

providing one or more v-shaped troughs moveable with and positioned along the upper platform;

supporting a plurality of oilfield members on the upper platform each having a tubular axis generally parallel with a plane including the substantially planar supporting surface;

tilting the upper platform with the plurality of oilfield members thereon on at a selected angle relative to the base;

positioning a selected one of the plurality of oilfield members within a selected one of the one or more v-shaped troughs while the upper platform is tilted; and powering an ejection unit for moving the oilfield member received within the selected one of the one or more v-shaped troughs while the upper platform is tilted, thereby positioning at least an upper end of the oilfield member at a desired position relative to the derrick floor.

29. The method as defined in claim 28, further comprising:

pivotally connecting an inclined slide member at its upper end to the upper platform; and actuating a hydraulic ram mounted on the lower base to slidably move a lower end of the inclined slide member to tilt the upper platform with the plurality of oilfield members thereon.

30. The method as defined in claim 28, further comprising:

sensing the position of the upper platform and terminating tilting of the upper platform relative to the base when the upper platform reaches a selected inclination with respect to the lower base.

31. The method as defined in claim 28, further comprising:

providing a push member for engaging the oilfield member while moving along the selected one of the one or more v-shaped troughs, the push member at least substantially enclosing the selected use of the one or more v-shaped troughs.

32. The method as defined in claim 30, further comprising:

sensing the position of the push member relative to the selected one of the one or more v-shaped troughs and terminating power to the ejection unit when the push member reaches a selected position.

33. The method as defined in claim 28, further comprising:

providing one or more v-shaped troughs includes providing a first v-shaped trough and a second v-shaped trough along the upper platform, the first and the second v-shaped troughs each having a trough axis generally parallel to the central platform axis, the second v-shaped trough being spaced laterally opposite the first v-shaped trough with respect to the central platform axis.

34. The method as defined in claim 33, further comprising:

moving an oilfield member from the upper platform into the second v-shaped trough while the selected one of the plurality of oilfield members is received within the first v-shaped trough for being moved onto the derrick floor.

35. The method as defined in claim 28, further comprising:

providing a vertical guide secured to the base; and slidably interconnecting a rear end of the upper platform to the vertical guide such that the rear end of the upper platform may be raised relative to the base.

36. The method as defined in claim 35, further comprising:

powering a first hydraulic ram to tilt a front end of the upper platform relative to the base; and providing a second hydraulic ram for raising a rear end of the upper platform relative to the lower base.

37. The method as defined in claim 36, further comprising:

initiating power to the second hydraulic ram when the elongate upper platform reaches a selected inclination with respect to the lower base in response to powering the first hydraulic ram.

* * * * *